US007147346B2

(12) United States Patent
Grimmeisen

(10) Patent No.: US 7,147,346 B2
(45) Date of Patent: Dec. 12, 2006

(54) FLAT LIGHTING FIXTURE

(75) Inventor: Gerhard Grimmeisen, Haagi OB (DE)

(73) Assignee: Grimmeisen Vertriebs GmbH, Wasserberg (DE)

( * ) Notice: Subject to any disclaimer, the term of this patent is extended or adjusted under 35 U.S.C. 154(b) by 70 days.

(21) Appl. No.: 10/510,131

(22) PCT Filed: Apr. 9, 2003

(86) PCT No.: PCT/DE03/01163

§ 371 (c)(1),
(2), (4) Date: Apr. 1, 2005

(87) PCT Pub. No.: WO03/087659

PCT Pub. Date: Oct. 23, 2003

(65) Prior Publication Data

US 2005/0180131 A1 Aug. 18, 2005

(30) Foreign Application Priority Data

Apr. 10, 2002 (DE) ..... 102 15 744

(51) Int. Cl.
*F21S 4/00* (2006.01)

(52) U.S. Cl. ..... 362/217; 362/223; 362/225; 362/260

(58) Field of Classification Search ..... 362/217, 362/223, 225, 260, 147
See application file for complete search history.

(56) References Cited

U.S. PATENT DOCUMENTS 3,078,366 A * 2/1963 Winkler ..... 362/223
5,473,522 A * 12/1995 Kriz et al. ..... 362/221

FOREIGN PATENT DOCUMENTS

| | | |
|---|---|---|
| DE | 200 04 356 U | 5/2000 |
| DE | 201 05 443 U1 | 7/2001 |
| FR | 2 288 273 | 5/1976 |

* cited by examiner

*Primary Examiner*—Stephan F Husar
*Assistant Examiner*—James W Cranson, Jr.
(74) *Attorney, Agent, or Firm*—Nixon & Vanderhye P.C.

(57) ABSTRACT

The invention relates to a multifunctional lighting fixture having at least one fluorescent lamp mounted inside a flat lighting fixture housing comprised of two rectangular frames. Each frame consists of preferably only one lateral wing running parallel to the fluorescent lamp, and front wings situated therebetween, whereby spacer elements and edged spacer edge connectors hold the lateral wings and front wings of both frames at a predetermined distance. The lighting fixture can be combined in many ways both during initial assembly as well as for a subsequent conversion and can be assembled in the form of a built-on lamp or suspended lamp, a vertically or horizontally mounted wall lamp, floor lamp standing lamp or cable lighting fixture without modifying the base body of the lighting fixture. In addition, different light distributing elements can be used in an exchangeable manner so that the light is both directly oriented onto a useful surface as well as deflected in an indirect and preferably colored manner. Additional light sources, e.g. high-voltage halogen spotlights can be freely attached. The lighting fixture constitutes, with standardized elements, a flat light fixture design that is, on the whole, aestheticaily appealing.

11 Claims, 9 Drawing Sheets

FLAT LIGHTING FIXTURE

This application is the US national phase of international application PCT/DE03/01163 filed 9 Apr. 2003 which designated the U.S. and claims priority of DE 102 15 744.8, filed 10 Apr. 2002, the entire contents of each of which are hereby incorporated by reference.

The invention relates to a luminaire having at least one luminous means in a flatly constructed luminaire housing composed of two rectangular frames. Such luminaires are known and described, for example, in DE 201 05 443 U1.

However, these luminaires have a relatively large overall height. It is also a disadvantage that the luminaires available on the market are designed only for precisely one type of mounting. It is therefore impossible to subsequently change the function of the same luminaire and use the latter for other types of mounting without changing its basic body in the process.

A further disadvantage is the complicated production of such luminaires.

It is therefore the object of the present invention to form a luminaire of the type mentioned at the beginning such that the luminaire can be combined in many ways both when first being mounted and for a later rededication, and can be mounted as a build-on or suspended luminaire, a vertically or horizontally arranged wall luminaire, a floor luminaire, standard luminaire or wire luminaire without altering the basic body of the luminaire in the process.

An object in this case is to be able to use various light distribution elements exchangeably such that the light both is guided directly onto a useful surface and is deflected indirectly and preferably in a colored fashion, and that further light sources such as high-voltage halogen radiators for example, can also be freely attached.

A further object in this case is that it is also possible to use standardized elements even for a particularly flat luminaire design, in order to obtain an esthetically filigreed luminaire.

These objects are achieved by means of the features of the luminaire as claimed in claim 1. Special embodiments of the present invention are to be gathered from the subclaims.

Various exemplary embodiments of the invention will be explained in more detail below with the aid of drawings.

Figure 1:
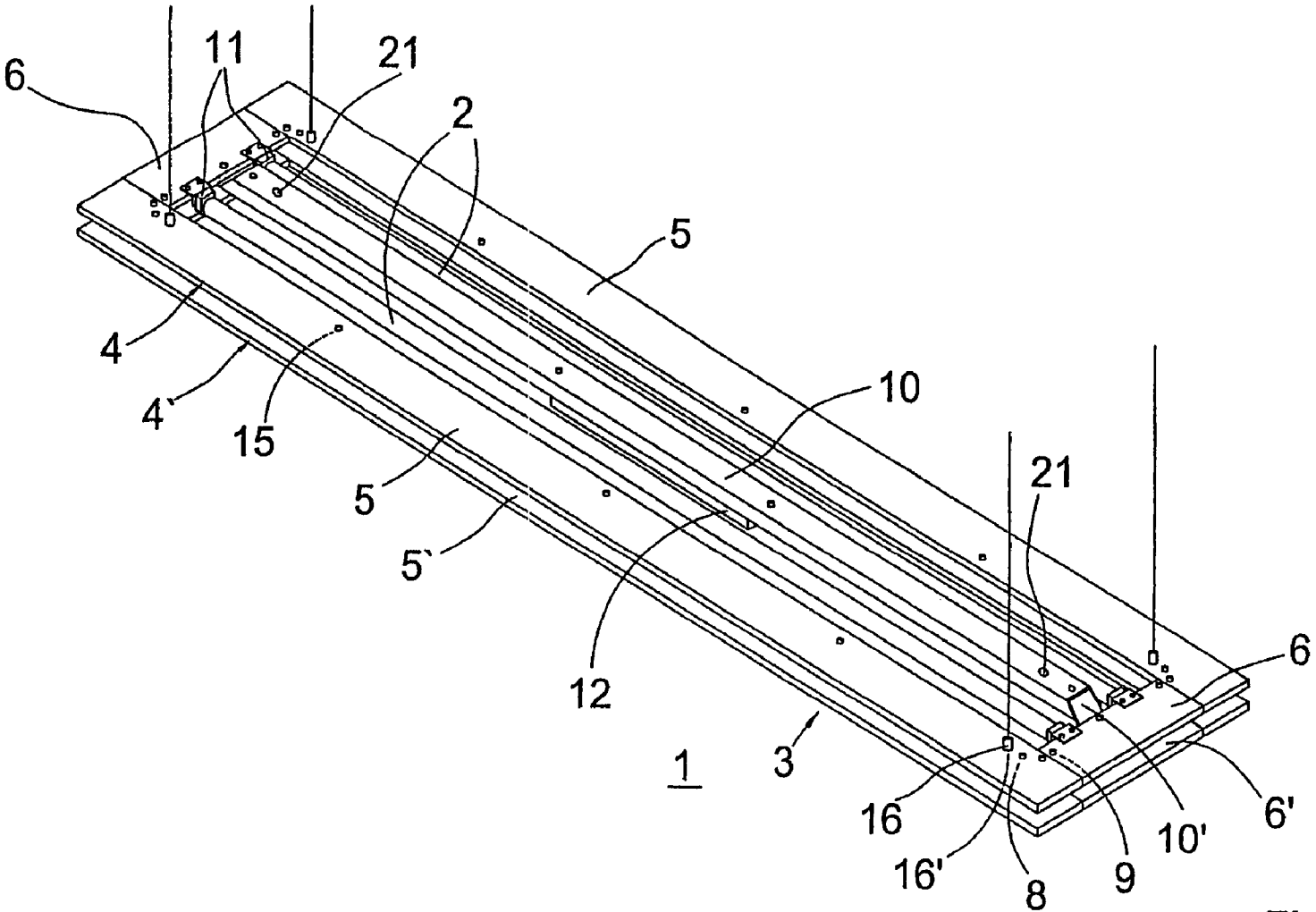

FIG. 1 shows in perspective an embodiment of a luminaire on a wire suspension as a suspended version.

Figure 2A:
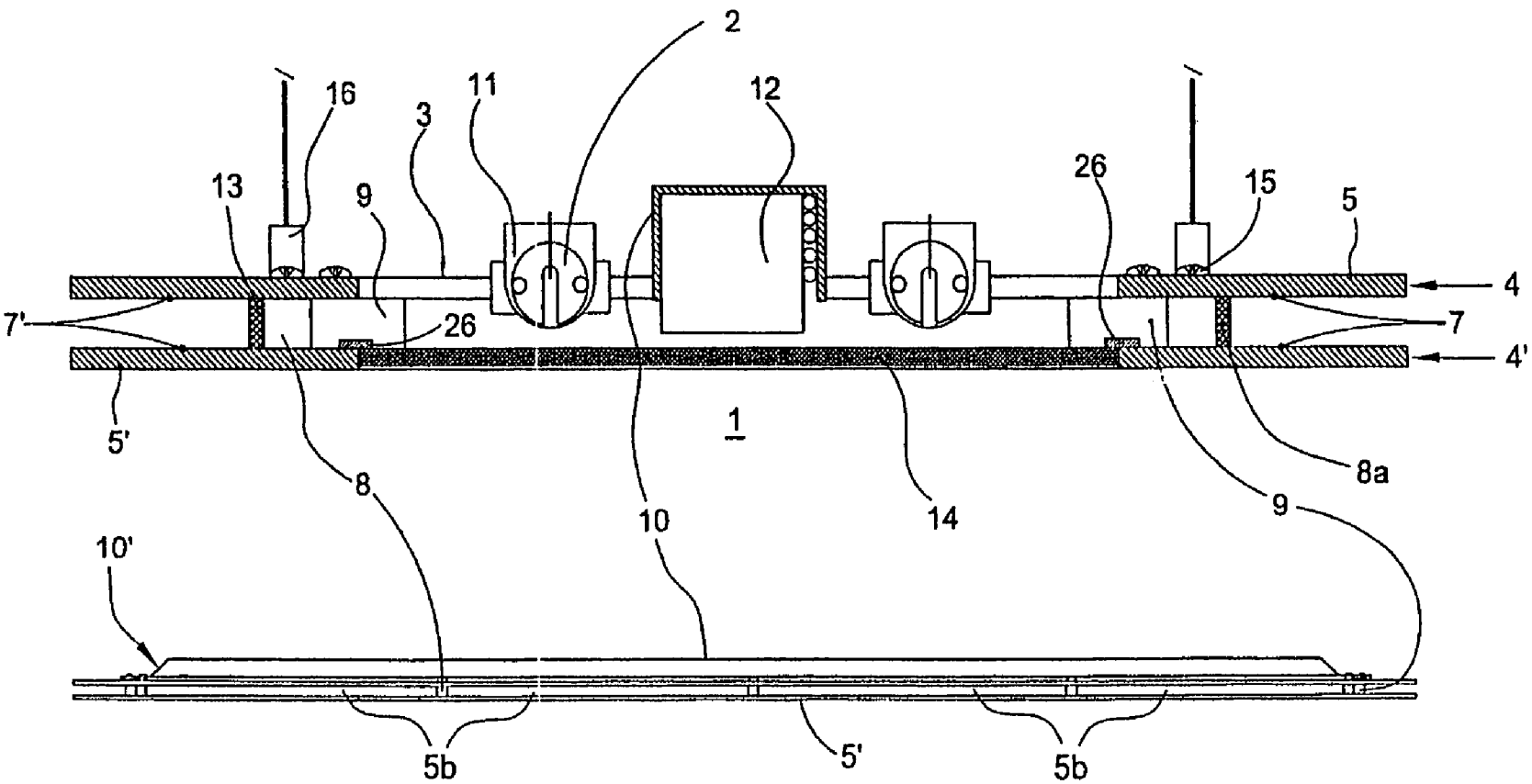
Figure 2B:
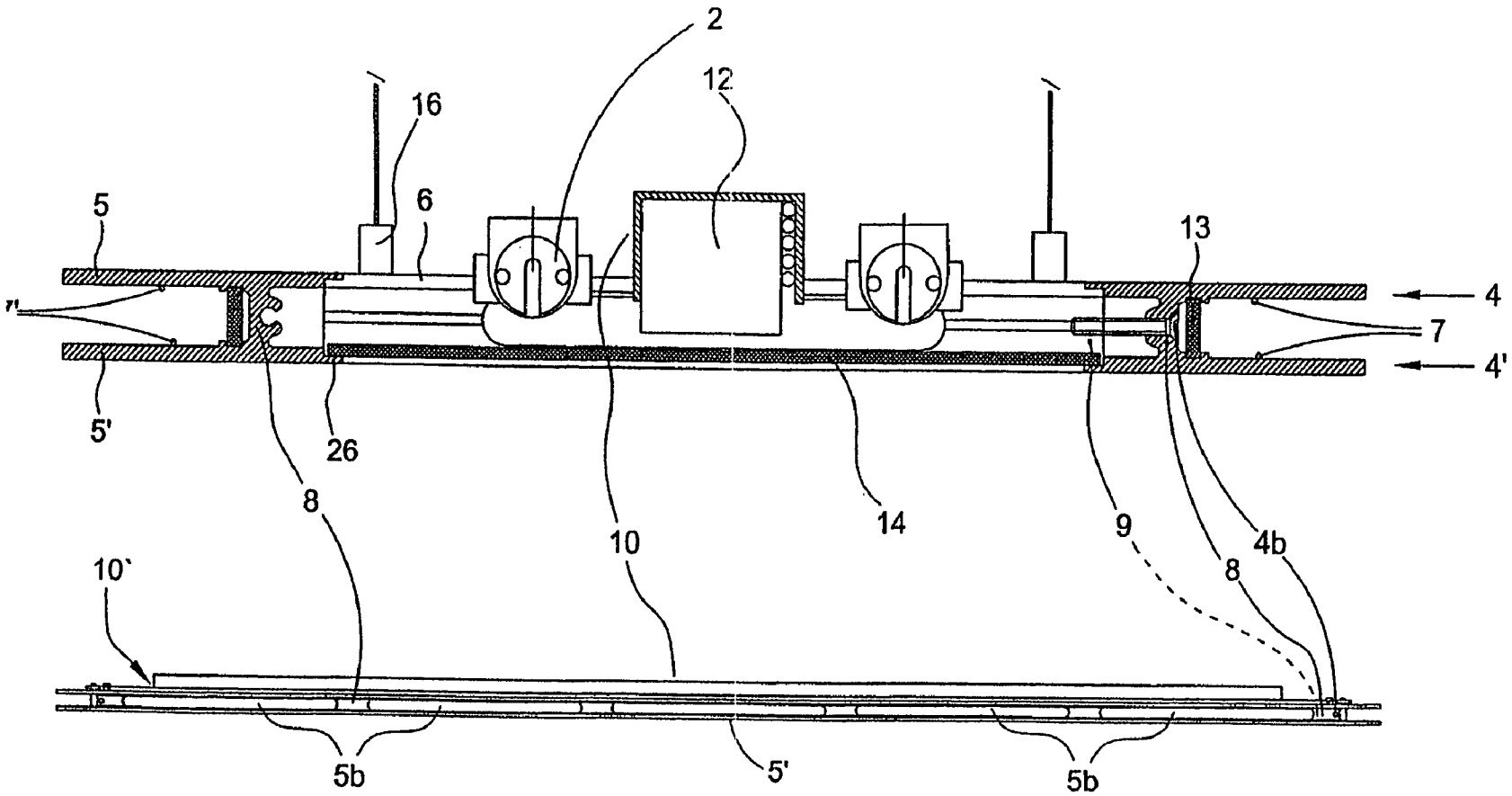

FIGS. 2*a*, 2*b* show two embodiments of the luminaire in transverse and longitudinal section.

Figure 3:
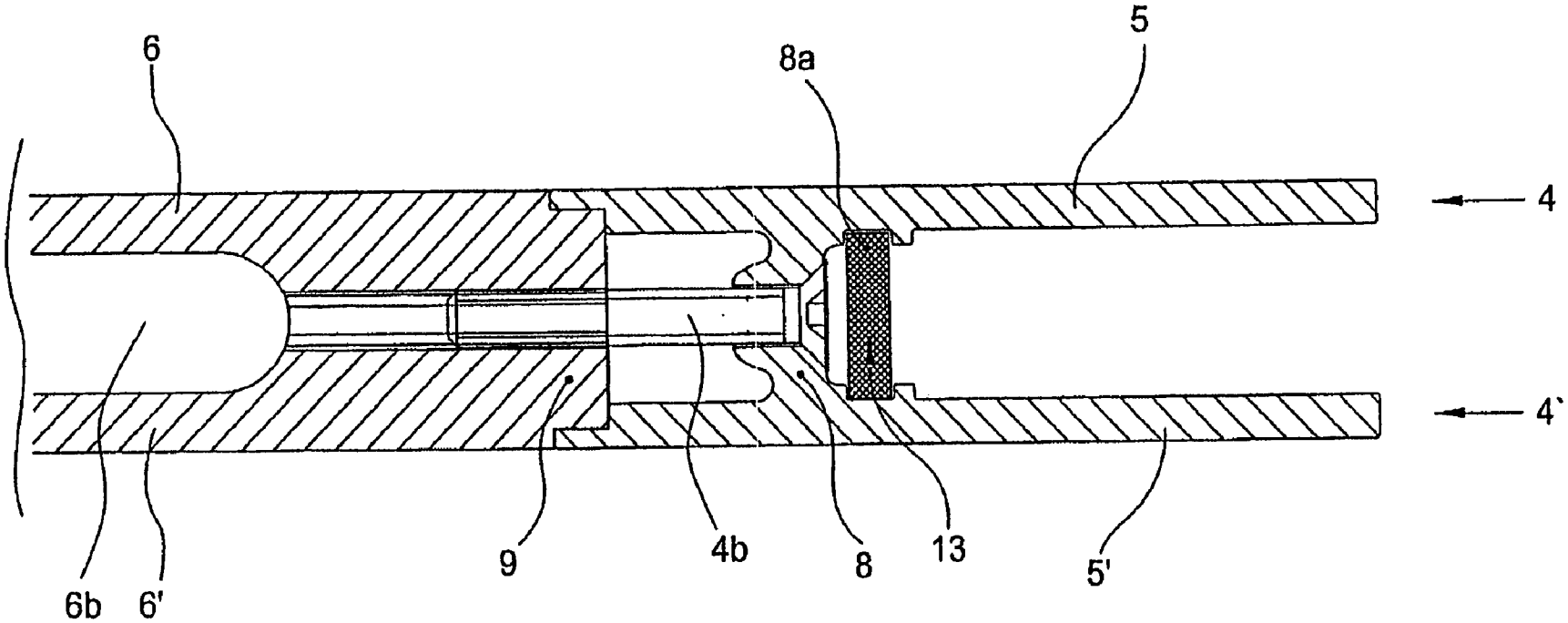

FIG. 3 shows further details of an embodiment in cross section.

Figure 4A:
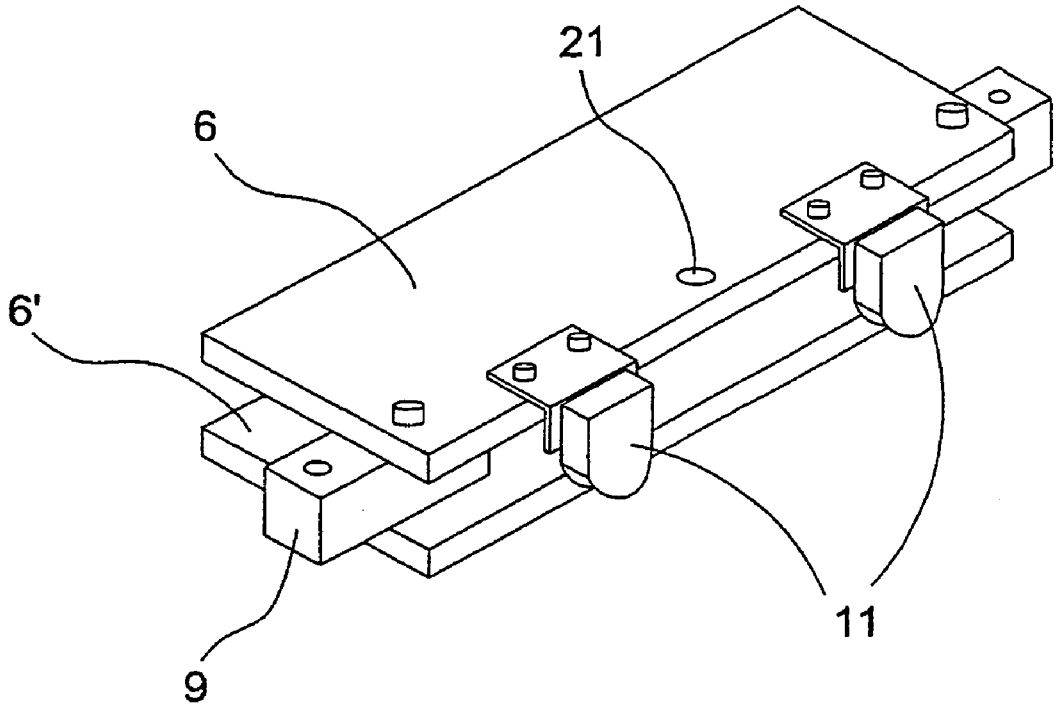
Figure 4B:
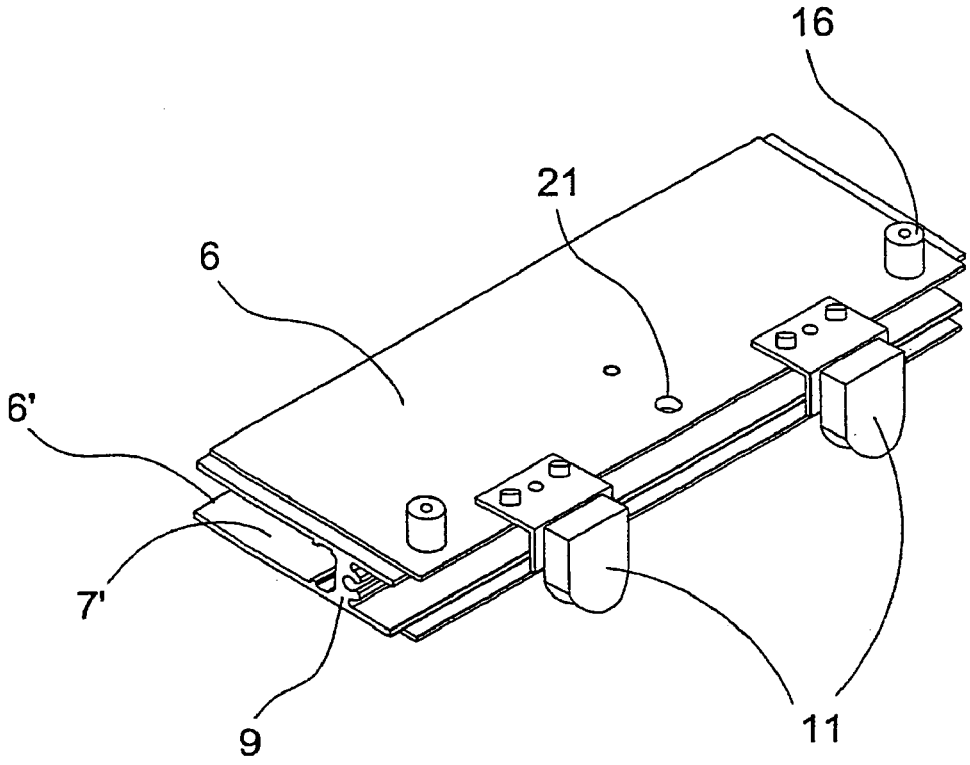

FIGS. 4*a*, 4*b* show in perspective further details of the front wings of two embodiments of the luminaire.

Figure 5:
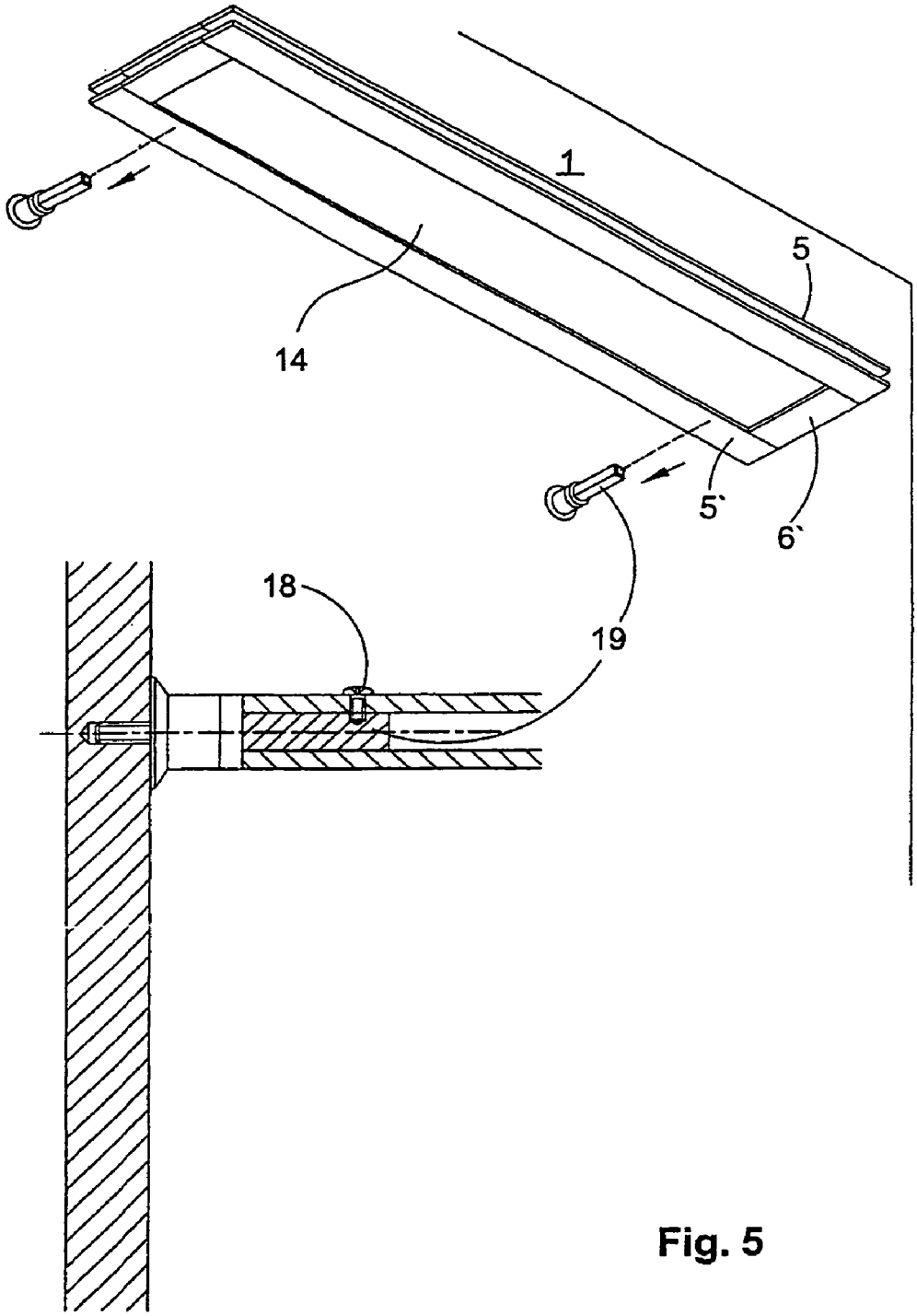
Figure 6:
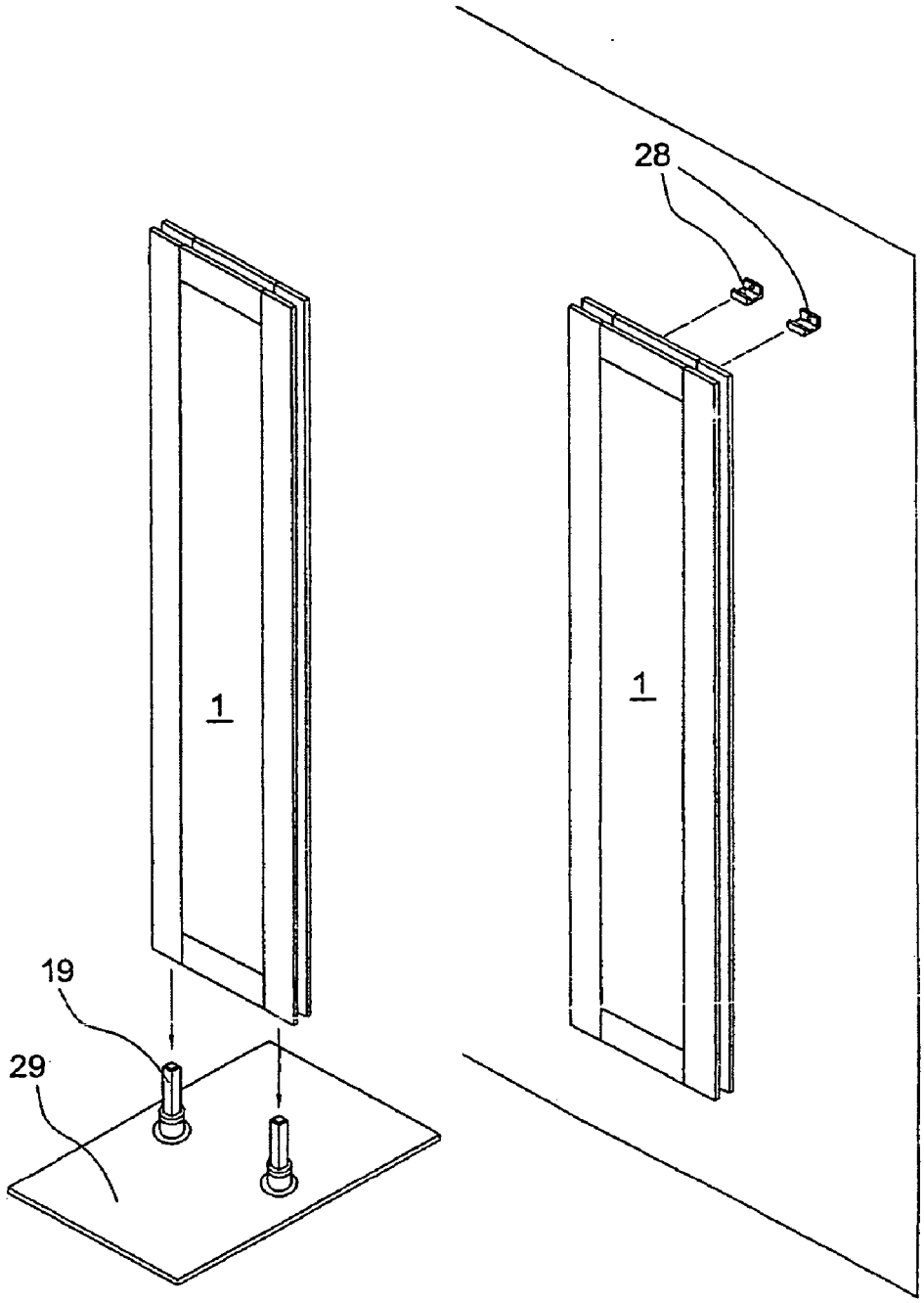
Figure 7:
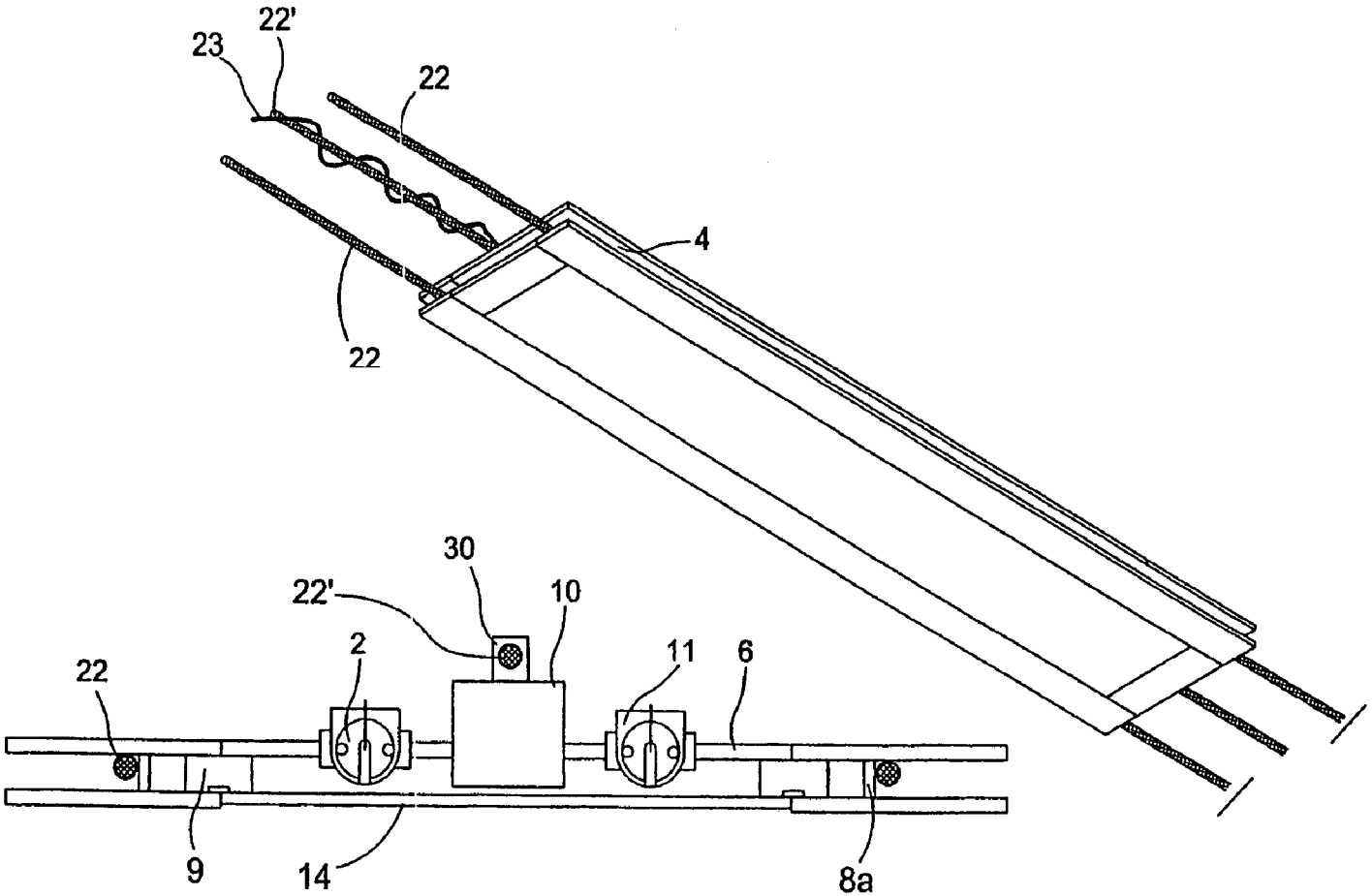

FIGS. 5–7 show in perspective various types of mounting for embodiments of the luminaire.

FIG. 1 shows diagrammatically a perspective illustration of the luminaire 1, obliquely from above. The luminaire has a flatly constructed and longitudinally extending luminaire housing 3 with two frames 4, 4' that are held at a constant and fixed spacing with the aid of spacer elements 8, 8*a* and angled spacer corner connectors 9.

The spacer elements and/or angled spacer corner connectors can for this purpose firstly be connected in one piece to the corresponding wings, or secondly also consist of separately fabricated pieces.

Located in the middle region of the frame in the longitudinal direction of the luminaire housing is a profile 10 that firstly holds the devices such as ballast 12, clamping and plug-in connectors and, furthermore, at the same time, serves as cable duct for laying and guiding cables. This profile is, for example, a U profile or a square profile, and is preferably arranged in a fashion detachably mounted on the transverse sides of the frame 4, for example, with the aid of matched retaining angles 10'. The profile has ends cut in a mitred fashion, for example.

In one exemplary embodiment, longitudinally running fluorescent lamps 2 are arranged left and right next to the profile 10. In the case of a ceiling connection, the luminaire 1 is suspended with two or, as illustrated, with four wires. In a further mounting version, the luminaire 1 can be fastened directly on the ceiling by means of screws with the aid of the mounting bores 21 on the profile 1.

FIGS. 2*a*, 2*b* show two embodiments of the luminaire, both in cross section, that is to say looking onto the front wings, and in longitudinal section. The cross section shows that the two frames 4, 4' are held at a defined spacing from one another with the aid of spacer elements 8, 8*a* and angled spacer corner connectors 9, and therefore form a hollow chamber.

Light windows 4*a* in which the light radiates from inside to outside are formed in the longitudinal view (below) in both figures.

FIG. 2*a* shows an embodiment in the case of which wings, spacer elements and angled spacer corner connectors are assembled cost effectively from standard elements that must, however, each be procured and stored per se.

For the embodiment shown in FIG. 2*b* wings are connected to one another in one piece, in a fashion drawn over a web, the web only being milled out after that in a suitable way to form a light window 4*a* so that the spacer elements and angled spacer corner connectors are substantially of the same shape, as a result of which the stability of the luminaire 1 is substantially increased and storage and mounting are also facilitated.

FIG. 3 shows further details of such an embodiment, spacer elements at the ends of the lateral wings being provided at least there as counterpart for connecting the two frames, preferably with the aid of frame screws 5*b*. The material of the frames can be freely selected.

Translucent or opaque plastic, any desired metal, or else a combination of the materials is advantageous as the material. The surface can be anodized, varnished, powder-coated, or chrome plated.

The cross-sectional profile of the frame is preferably that of a solid flat material. The surface should be designed such that it is possible to form reflective surfaces 7, 7' that deflect light diffusely and couple it out all around effectively from the frame. If the width of one or more of the lateral wings and front wings of one frame is greater than that of the corresponding other frame, the emerging light is visible in a particularly effective way.

To deflect and couple out light in a colored fashion, it is possible for colored light distribution elements 13 to be pushed into and fastened in the hollow chamber or a specified constant spacer region between the mutually facing and, possibly, elegantly curved surfaces 7, 7' on all sides of the luminaire housing, said light distribution elements preferably being in contact with the spacer elements 8 and angled spacer corner connectors 9. If such light distribution elements 13 are also used instead of the spacer holders, they can take over the function of the latter and are denoted in the drawings as 8*a*. The light distribution elements 13 are optionally only present between the opposing lateral wings of the two frames, or they form a closed circumferential unit of the luminaire 1. A further light distribution device 14 extends below the fluorescent lamps 2 and is inserted without tools at edge holders, for example, with the aid of two mounting profiles 26 in the lower frame 4, with the aid of which the light is guided downward with direct distribution onto the useful surface. The light distribution device 14 can be produced from any desired material, such as plexiglass, and can have a geometric or prismatic scattering structure. For this purpose, the light distribution device can be provided on its underside with a suitable scattering structure, for example, with a grooved or prismatic structure, such that the light can propagate diffusely or with suppression of glare. On the other hand, it can also be a profile structure having a multiplicity of optically refracting surfaces by which the light is likewise diffusely scattered.

The cross section of the U profile 10 with a ballast 12 fastened therein is arranged approximately in the middle.

FIGS. 4*a*, 4*b* show two embodiments having front wings 6, 6', preassembled on the spacer corner connectors 9 of the two frames 4, 4', the mounts 11 preferably applied from the outside for two longitudinally running fluorescent lamps 2 and a bore for fastening a U profile 10.

FIG. 5 shows a wall luminaire as variant embodiment with a mounting example.

Two fastening bolts 19 are mounted on the wall with a flange and a screw. The fastening bolts 19 preferably have a square cross section with the same outside dimensions as the inside dimension of the hollow chamber, and therefore fit one another exactly. The fastening bolts are fastened between the frames, 4, 4' of the luminaire 1 by means of a clamping screw 18 in the threaded bore 16'. Ideally, use is made in this case of the threaded bore that also serves, inter alia, for fastening the wire suspension.

FIG. 6 shows (right-hand image) as a further mounting example, a wall luminaire that is fastened on the wall by means of two matching fastening angles 28, preferably with the aid of one screw each. The fastening angles have in cross section a U profile of special dimension such that the luminaire 1 can be suspended on a lateral wing or front wing. The luminous means of the luminaire are thus suspended running vertically or horizontally like a picture and independently of whether the lateral wings are longer than the front wings or not.

FIG. 6 shows also (left-hand image) as a further mounting example, a standard luminaire with two fastening bolts 19 on a base plate 29. The fastening bolts preferably have a square cross section, their outside dimensions being equal in an accurately fitting fashion with the inner spacing between the frames 4, 4' (preferably approximately 10 mm).

As a further variant embodiment, FIG. 7 shows a luminaire fastened on two clamping wires, two special clamping wires 22 as carriers of the luminaire 1 being clamped with the aid of clamping elements from wall to wall or from ceiling to floor. With this variant, supply is performed via a spiral cable 23 that is guided on a third clamping wire 22. The luminaire 1 can therefore be flexibly displaced freely in space in the direction of the clamping wire 22. Guides for the clamping wire are present in the luminaire along the spacer corner connectors 9 below the upper frame 4 and in a cutout of the profile. The clamping wire 22' present in the middle above the U profile 10 is guided on the wire holder 30 and secured. However, the spiral cable 23 can also simply be guided along a special clamping wire 22 serving as carrier of the luminaire 1.

The embodiments described with the aid of the figures are not to be understood as an exhaustive listing for the design of the invention claimed. Thus, a recumbent floor luminaire (not shown) is provided as a further mounting example, the luminaire being situated on four spacer feet that are not screwed with the aid of the threaded bores 15. A further mounting example (not shown) is a suspended luminaire as in FIG. 1, but suspended in the longitudinal direction on only two wires and mounted hanging vertically. If necessary, it is also possible to make use in addition of conventional components (not shown) to secure the luminaire 1 against slippage of the clamping wire. A further example of application is for the luminaire, which is extremely versatile despite its simple and cost-effective design, to be operated together with auxiliary units and thus, for example, as a suspended luminaire with two high-voltage radiators 24 2 (4×)×50 W/230 V. In this case, radiators in the form preferably of clamping reflector luminaires or the like are fastened on the upper flat frame 4 of the luminaire 1. They are connected electrically to the luminaire with the aid of a plug-in contact element 25, and can thus be operated jointly with the luminaire. It is particularly easy to make a fastening also on any projecting wings. For example, the width of the lateral wings 5 and/or of the front wings 6 of one frame 4 may be seen to extend beyond the width of the corresponding wings 5', 6' of the other frame 4' and thereby brings to bear in a particularly effective way the colored light distribution elements used.

A further example of application is a standard luminaire (not shown), the luminaire being held as usual between the frames with the aid of accurately fitting bolts and a support structure.

Two fluorescent lamps or high-voltage halogen lamps or metal-vapor lamps or LED lighting elements are preferably provided as luminous means 2 in the mounts 11 of the front wings 6, 6'.

The light distribution device 14 can be an opaque cover plate that is mounted as a reflector next to the profile 10. Another embodiment is, for example, a luminous array having longitudinally running reflectors and transversely running louvres, or a plastic plate having a number of hollow chambers running in the longitudinal direction or having prismatic structures in a plexiglass plate.

LIST OF REFERENCE NUMERALS

1 Luminaire
2 Luminous means
3 Luminaire housing
4, 4' (Upper, lower) frame
4*b* Frame screw
5, 5*a*, 5', 5*a'* Lateral wings
5*b* Light window lateral wing
6, 6*a*, 6', 6*a'* Front wings
6*b* Light window front wing
7, 7' Mutually facing surfaces
8, 8*a* Spacer elements
9, 9*a* Angled spacer corner connectors
10 U profile
10' Retaining angle.
11 Mounts
12 Ballast
13 Light distribution elements
14 Light distribution device
15 Threaded bore
16 Wire suspension
16' Threaded bore
17 Spacer feet
18 Clamping screw
19 Fastening bolts for wall or base plate mounting
21 Mounting bores
22 Clamping wire 1+2
22' Clamping wire 3

23 High-voltage spiral cable 230 V
24 External light sources
25 Plug-in contact element
26 Mounting profile
28 Fastening angle wall mounting vertical
29 Base plate
30 Wire holder

The invention claimed is:

1. A luminaire having at least one luminous means in a flatly constructed luminaire housing consisting of two rectangular frames with longitudinal and transverse sides, characterized in that each frame is composed of lateral wings parallel to the at least one luminous means, and front wings transverse thereto, in that the mutually facing surfaces of the two frames are substantially constructed as reflective surfaces, in that spacer elements keep the opposing lateral wings of the two frames at a prescribed spacing, in that in each case two angled spacer corner connectors interconnect the respectively opposing front wings of the two frames and thus support the connection of the front wings to the associated side wings of the corresponding frame at the prescribed spacing, in that a profile is fastened on a frame in order to reinforce the luminaire housing, and in that mounts for the at least one luminous means are fastened on the front wings of the reinforced frame.

2. A luminaire as claimed in claim 1, in which, in addition to or instead of spacer elements, light distribution elements are pushed in between the mutually facing surfaces of the lateral wings and/or front wings such that light exits laterally from the luminaire housing and substantially all around in a diffuse fashion as preferably colored light.

3. A luminaire as claimed in claim 1, in which the angled spacer corner connectors, can be detachably connected to the associated lateral wings of the corresponding frame by butting and/or by form-fitting and/or by means of the spacer elements.

4. A luminaire as claimed in claim 1, in which, acting as a cable duct on the reinforced frame of the luminaire housing, the profile also holds auxiliary units.

5. A luminaire as claimed in claim 1, in which a light distribution device is additionally arranged along the at least one luminous means on the luminaire housing such that light is predominantly guided directly and in a substantially neutral fashion on to a useful surface.

6. A luminaire as claimed in claim 5, in which the light distribution device consists of a scattering material or is coated therewith, and has a geometric scattering structure.

7. A luminaire as claimed in claim 1, in which the luminaire housing consists of metal or plastic or both and is composed of in each case unipartite flat lateral wings and front wings with an essentially rectangular cross sectional profile.

8. A luminaire as claimed in claim 1, in which the angled spacer corner connectors and lateral wings are formed as a receptacle and in order to guide a clamping wire such that the luminaire can be freely displaced in space in the wire direction.

9. A luminaire as claimed in claim 1, in which threaded bores for fastening elements preferably of reinforced frames are prepared for mounting purposes, mounting bores preferably in the profile.

10. A luminaire as claimed in claim 1, in which the angled spacer corner connectors are formed such that they project beyond the front wings below the lateral wings.

11. A luminaire as claimed in claim 1, in which the in each case two angled spacer corner connectors together with the respectively opposing front wings are formed in one piece.

* * * * *